US009640003B2

(12) United States Patent
T. et al.

(10) Patent No.: US 9,640,003 B2
(45) Date of Patent: May 2, 2017

(54) SYSTEM AND METHOD OF DYNAMIC SUBJECT TRACKING AND MULTI-TAGGING IN ACCESS CONTROL SYSTEMS

(71) Applicant: Honeywell International Inc., Morristown, NJ (US)

(72) Inventors: Shanmuganathan T., Tamilnadu (IN); Abhisekh Jain S., Tamilnadu (IN); Eben Gnana Pradeep S., Tamilnadu (IN); Sridhar Jayabal, Tamilnadu (IN); Savari Raj, Tamilnadu (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 250 days.

(21) Appl. No.: 14/270,942

(22) Filed: May 6, 2014

(65) Prior Publication Data

US 2015/0325101 A1 Nov. 12, 2015

(51) Int. Cl.

| | |
|---|---|
| ***G08B 1/08*** | (2006.01) |
| ***G07C 9/00*** | (2006.01) |
| *G08B 13/196* | (2006.01) |

(52) U.S. Cl.

CPC .... *G07C 9/00111* (2013.01); *G08B 13/19645* (2013.01)

(58) Field of Classification Search

CPC ..... G08B 25/10; G08B 25/14
USPC ..... 340/539.13, 528, 539.1, 539.2, 539.23
See application file for complete search history.

(56) References Cited

U.S. PATENT DOCUMENTS

| | | | | |
|---|---|---|---|---|
| 5,225,842 | A | 7/1993 | Brown et al. | |
| 5,541,845 | A | 7/1996 | Klein | |
| 6,069,555 | A * | 5/2000 | Skitek | G07C 9/00039 340/286.14 |
| 6,418,372 | B1 | 7/2002 | Hofmann | |
| 6,424,264 | B1 * | 7/2002 | Giraldin | G06K 17/00 340/539.1 |

(Continued)

FOREIGN PATENT DOCUMENTS

| | | |
|---|---|---|
| WO | WO 02/31787 A1 | 4/2002 |
| WO | WO 03/090174 A1 | 10/2003 |

OTHER PUBLICATIONS

Extended European search report for corresponding corresponding EP patent application 15163935.8, dated Sep. 7, 2015.

*Primary Examiner* — Eric M Blount
(74) *Attorney, Agent, or Firm* — Husch Blackwell LLP

(57) ABSTRACT

An apparatus is provided that includes a user input of a security system receiving a respective identifier for each of a plurality of objects tracked within a secured area having a plurality of geographically separate spaces and a processor of the security system detecting entry of one of the plurality of objects into one of the plurality of geographically separate spaces via an access controller associated with the one of the plurality of geographically spaces, determining a geographic location of the one of the plurality of objects based upon detecting the entry, retrieving a map of the secured area along with a track of the one of the plurality of objects through the secured area, and displaying the geographic location of the one of the plurality of objects on the map through one of a portable handheld device, a monitoring station, and other possible human machine interface devices.

19 Claims, 3 Drawing Sheets

(56) References Cited

U.S. PATENT DOCUMENTS

| | | | | |
|---|---|---|---|---|
| 6,531,963 | B1 * | 3/2003 | Nyfelt | G01S 13/74 340/10.1 |
| 6,807,478 | B2 | 10/2004 | Giannopoulos et al. | |
| 7,035,650 | B1 | 4/2006 | Moskowitz et al. | |
| 7,167,094 | B2 * | 1/2007 | Ciarcia, Jr. | G07C 9/00111 340/541 |
| 7,242,306 | B2 * | 7/2007 | Wildman | A61B 5/1113 340/539.16 |
| 7,295,119 | B2 * | 11/2007 | Rappaport | G06F 17/509 340/5.8 |
| 7,367,497 | B1 | 5/2008 | Hill | |
| 7,397,381 | B2 * | 7/2008 | DiPiazza | G01S 13/74 340/539.13 |
| 7,513,425 | B2 | 4/2009 | Chung | |
| 7,541,926 | B2 * | 6/2009 | Dugan | G07C 9/00111 340/10.1 |
| 7,671,718 | B2 * | 3/2010 | Turner | G07C 9/00087 340/10.1 |
| 7,990,279 | B2 * | 8/2011 | Bouressa | G07C 9/00103 340/539.11 |
| 8,577,392 | B1 | 11/2013 | Pai et al. | |
| 8,624,970 | B2 * | 1/2014 | Krobath | 348/113 |
| 9,036,028 | B2 * | 5/2015 | Buehler | G08B 13/19602 348/159 |
| 9,159,210 | B2 * | 10/2015 | Jones, Jr. | G08B 13/19645 |
| 9,322,974 | B1 * | 4/2016 | Giobbi | G06K 7/10366 |
| 2003/0214407 | A1 | 11/2003 | Sweatte | |
| 2004/0008114 | A1 | 1/2004 | Sawyer | |
| 2005/0030176 | A1 | 2/2005 | Wagner | |
| 2006/0283938 | A1 * | 12/2006 | Kumar | G06K 17/00 235/382 |
| 2009/0014516 | A1 | 1/2009 | Kshirsagar et al. | |

* cited by examiner

SYSTEM AND METHOD OF DYNAMIC SUBJECT TRACKING AND MULTI-TAGGING IN ACCESS CONTROL SYSTEMS

FIELD

This application is directed to security systems and, more particularly, to the tracking of objects within the security systems.

BACKGROUND

Systems are known to detect threats within secured areas. Such systems typically include the use of one or more sensors that detect threats within the secured area. A local audible alarm may be provided to notify authorized occupants of any threats detected within the secured area.

Threats detected by such systems may include any of a number of events that threaten the health and/or safety of human occupants or assets. An example of a threat to human occupants may include toxic gas. Other threats may include fire, explosion, or unauthorized intruders.

In general, a security system may include a control panel that monitors each of the sensors within the secured area. The control panel may be located within the secured area and may include one or more terminals through which guards monitor the secured area.

The secured area may also include one or more closed circuit television (CCTV) cameras connected to the control panel. A guard located at a terminal coupled to the panel may monitor images provided by the cameras for threats.

Entry into the secured area may be controlled via a card reader located outside of entrances into the secured area. One or more cameras may be trained on the entrances. A guard may monitor these cameras and the people who enter and exit through the entrances.

While existing security systems work well, it is often difficult for a guard to quickly respond to a threat. For example, a guard may be patrolling a first part of the secured area when a threat arises in another part. Accordingly, a need exists for better methods of evaluating threats and resources available to address such threats.

DETAILED DESCRIPTION

Figure 1:
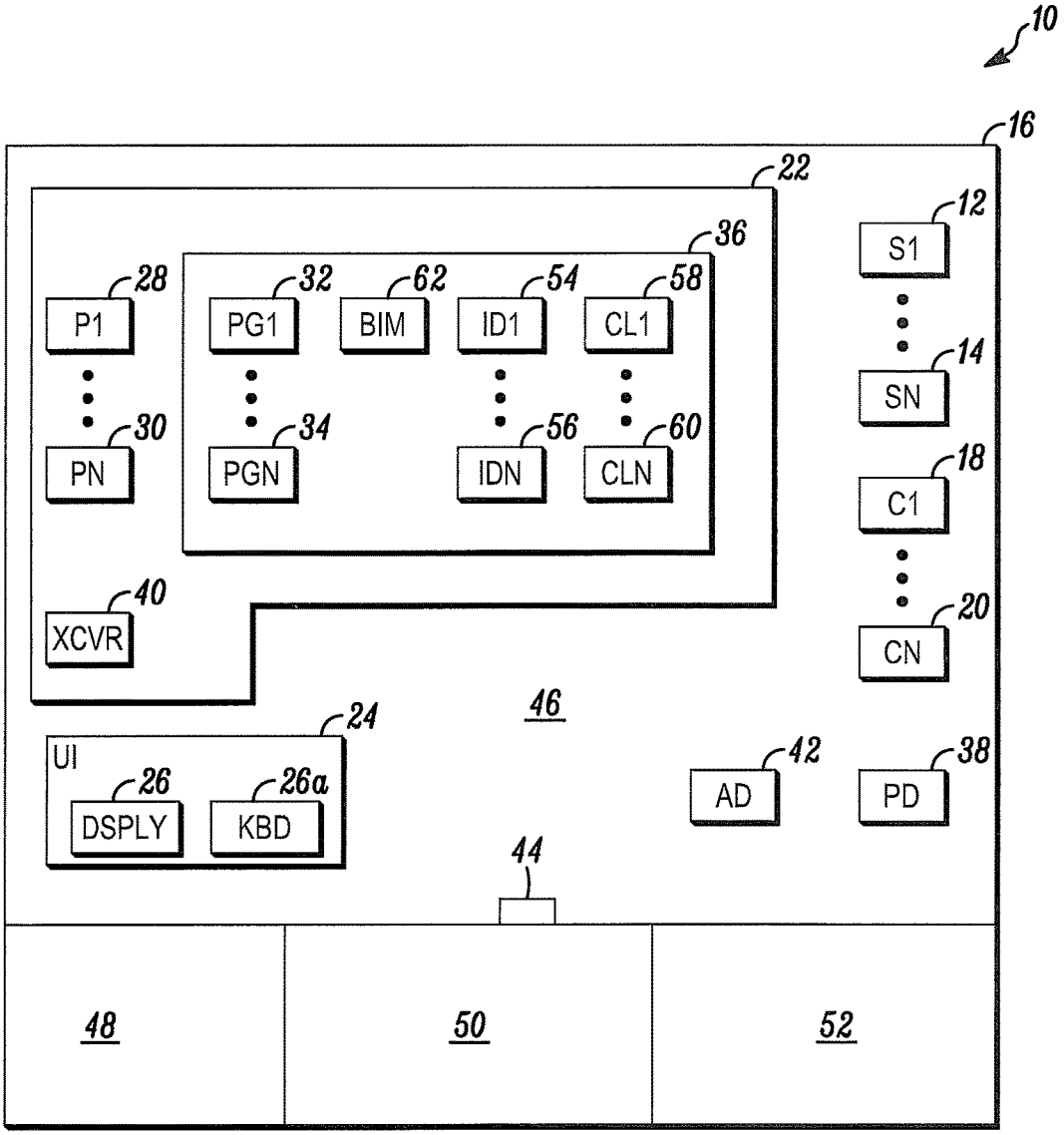
FIG. 1 illustrates a block diagram of a security system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

FIG. 1 is a simplified block diagram of a security system 10 shown generally in accordance with an illustrated embodiment. Included within the security system may be a number of sensors 12, 14 used to detect threats within a secured area 16.

The sensors may be based upon any of a number of different sensing technologies. For example, some of the sensors may be limit switches located upon doors and windows providing access into and egress from the secured area. Other sensors may be fire or toxic gas sensors intended to detect threats to the safety and health of human occupants of the secured area.

The secured area may also be protected via a number of CCTV cameras 18, 20. The cameras may be distributed throughout the secured area or only along a periphery of the secured area.

The sensors and cameras may be monitored via a control panel 22. The control panel, in turn, may be controlled by a human operator (e.g., a guard) through a user interface 24. The user interface may be incorporated into a guard station or terminal. The user interface may include a display 26 and a keyboard 26*a*. In some embodiments, the display and keyboard are combined through use of one or more touch-screen displays.

Included within the control panel may be one or more processor apparatuses (processors) 28, 30, each controlled by one or more computer programs 32, 34 loaded from a non-transitory computer readable medium (memory) 36. As used herein, reference to a step performed by a computer program is also reference to the processor that executed that step.

A guard may view a sequence of video images from the cameras via the user interface. In this regard, the user interface may include a number of control features associated with the user interface. For example, the user interface may include one or more pushbuttons for individually selecting each of the cameras. The pushbuttons may be hardware devices or software pushbuttons. Where embodied as one or more software pushbuttons, a pushbutton processor may display an icon of the associated device (e.g., a camera and identifier) and monitor the screen for selection of the icon via a user's finger making contact with the icon or via a cursor being placed over the icon and the user activating a switch on a mouse.

Upon activation of the pushbutton associated with a camera, a video processor may open a video window on the display. The processor may then couple video between the corresponding camera and the window.

Running in the background within the alarm panel may be one or more alarm processors that monitor the one or more sensors. Upon activation of one of the sensors, the corresponding alarm processor may display an alert notifying the guard monitoring the guard station. In the case of an intrusion sensor, the alert may include a notification of the type and location of the event.

The user interface may be embodied as a graphical user interface (GUI) incorporating a number of processing functions operating in the background. In this regard, the GUI couples an icon shown on the display with a corresponding processor within the alarm panel. One example of a processing function running in the background is the alarm processor. Another example is a processor controlling the display of video based upon activation of a corresponding icon.

The security system may also include one or more portable wireless devices 38. The portable devices may be coupled to the alarm panel via a corresponding set of wireless transceivers 40 located within the alarm panel and portable device.

The portable wireless devices may be used by a guard while the guard is on a tour away from the guard station. The wireless device may also include a GUI that couples the processes and processors of the alarm panel with the portable device.

The secured area may be divided into a number of different subareas or security zones 46, 48, 50, 52. The outside limits of each of the zones may be saved within a building information model (BIM) file. The limits of the zones within the BIM file may be defined by a set of geographic coordinates. The coordinates may be correlated to a map within the BIM file that shows the secured area, each of the subareas, the sensors, the access controllers, and the cameras.

Access into each of the areas may be controlled via a respective access controller 44. The access controller may include a card reader and an electrically activated lock that, when activated, unlocks a door allowing access into or egress from a respective portion of the secured area. Access controllers may be located completely inside the secured area only allowing access between portions of the secured area or may be used along a periphery of the secured area allowing access into or egress from the secured area.

Also used within the secured area may be one or more identification (ID) cards or tags 42. The ID cards may have a magnetic strip along one side encoded with identification information. Alternatively, each card may include a computer chip that may be interrogated for identification information. The cards may also be embodied as radio frequency identification (RFID) cards. The cards may be carried by authorized persons within the secured area or may be affixed to assets (e.g., laptops) used within the secured area.

As authorized persons or assets travel into the secured area and between subareas, a respective access controller outside of each area or subarea may read the identification information from the card carried by one of the persons or assets. As cards are read, the information may be compared to the contents of a number of identification files 54, 56 contained within a memory of respective access controllers or within the alarm panel. The files may contain identifying information of persons authorized to be given access into each of the security zones.

As authorized persons travel between zones, a verification processor detects the identifying information from each card and confirms that the person (or asset) carrying the card has authorization to enter the area where the card is read. A location processor coupled to the verification processor may also save a current geographic location into a respective location file 58, 60.

Operating in the background is a tracking processor that tracks the location of persons (e.g., guards) or objects (e.g., assets, intruders, etc.) within the secured area and presents the location information through the GUI. The tracking processor may track persons or assets based upon the locations of the access controllers reading the cards.

Alternatively, intruders may be tracked via one or more cameras. In this regard, an intruder may be detected via a sensor located along a periphery of the secured area or by a motion detection processor that analyzes images for changes between frames from a camera. Once a sensor is triggered, a camera located in the area may track the intruder via a motion tracking processor. As the intruder is tracked, a location of the intruder may also be saved into a respective intruder detection file.

Figure 2:
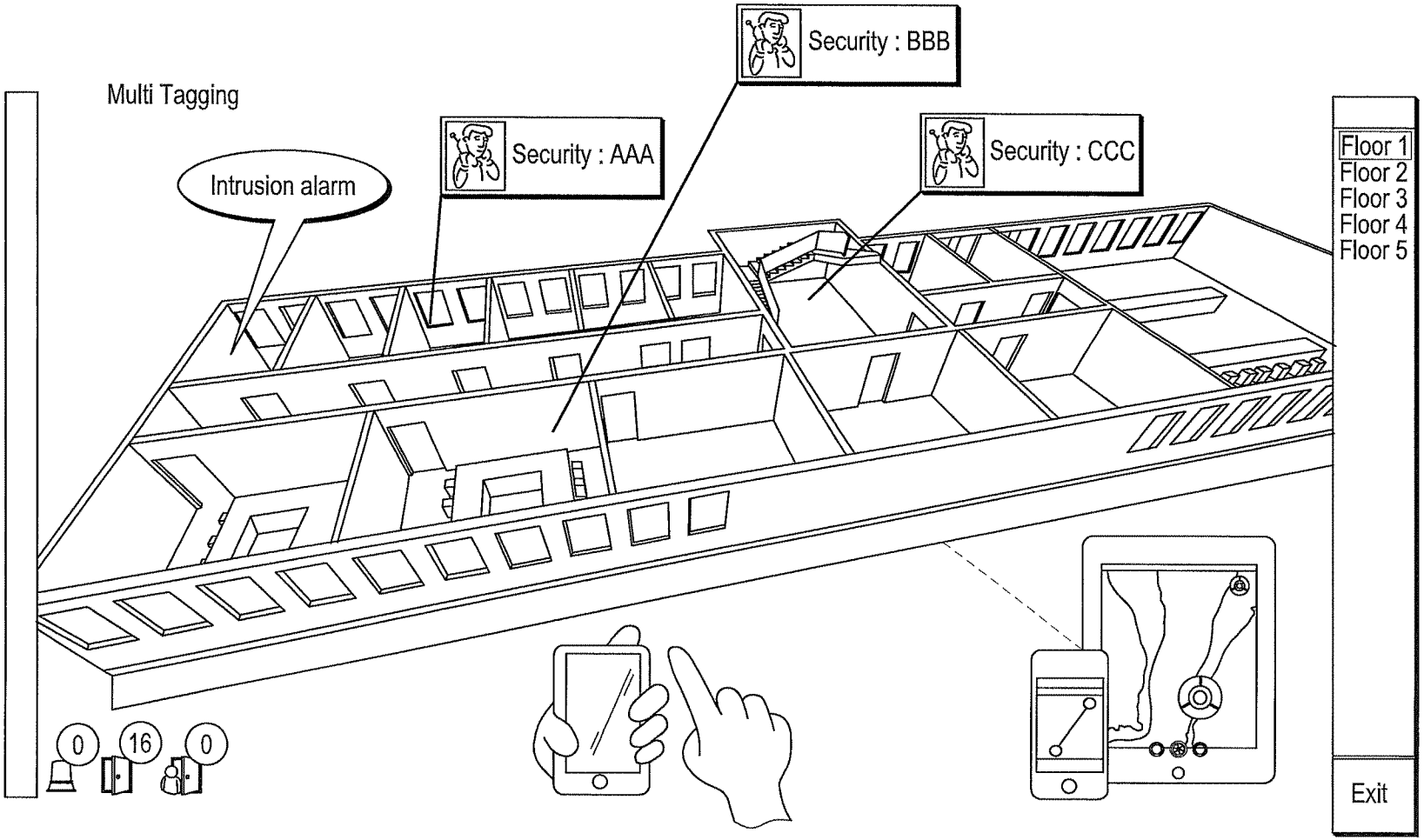
FIG. 2 depicts the display of tracked objects that may be generated by the system of FIG. 1.

Under one illustrated embodiment, a guard may enter identifiers of a number of objects that the guard wants to track within a particular portion of the secured area. For example, the guard may enter the identifier of all other guards within the secured area. The guard may perform this step in order to determine the proximity of other guards in the event of a threatening situation. For example, if the guard should be on a patrol through the secured area and receive a notification of an intruder through a portable device carried by the guard, then the guard may first select the notification of the event and then the tracking processor. In response, the tracking processor may search the location files to determine a location of each of the objects. The tracking processor may then correlate the geographic location of each of the objects with a corresponding location on the map from the BIM model. The tracking processor may then display the map through the GUI with the location of each of the objects (other guards) superimposed on the map along with the location of the intruder as shown in FIG. 2.

Figure 3:
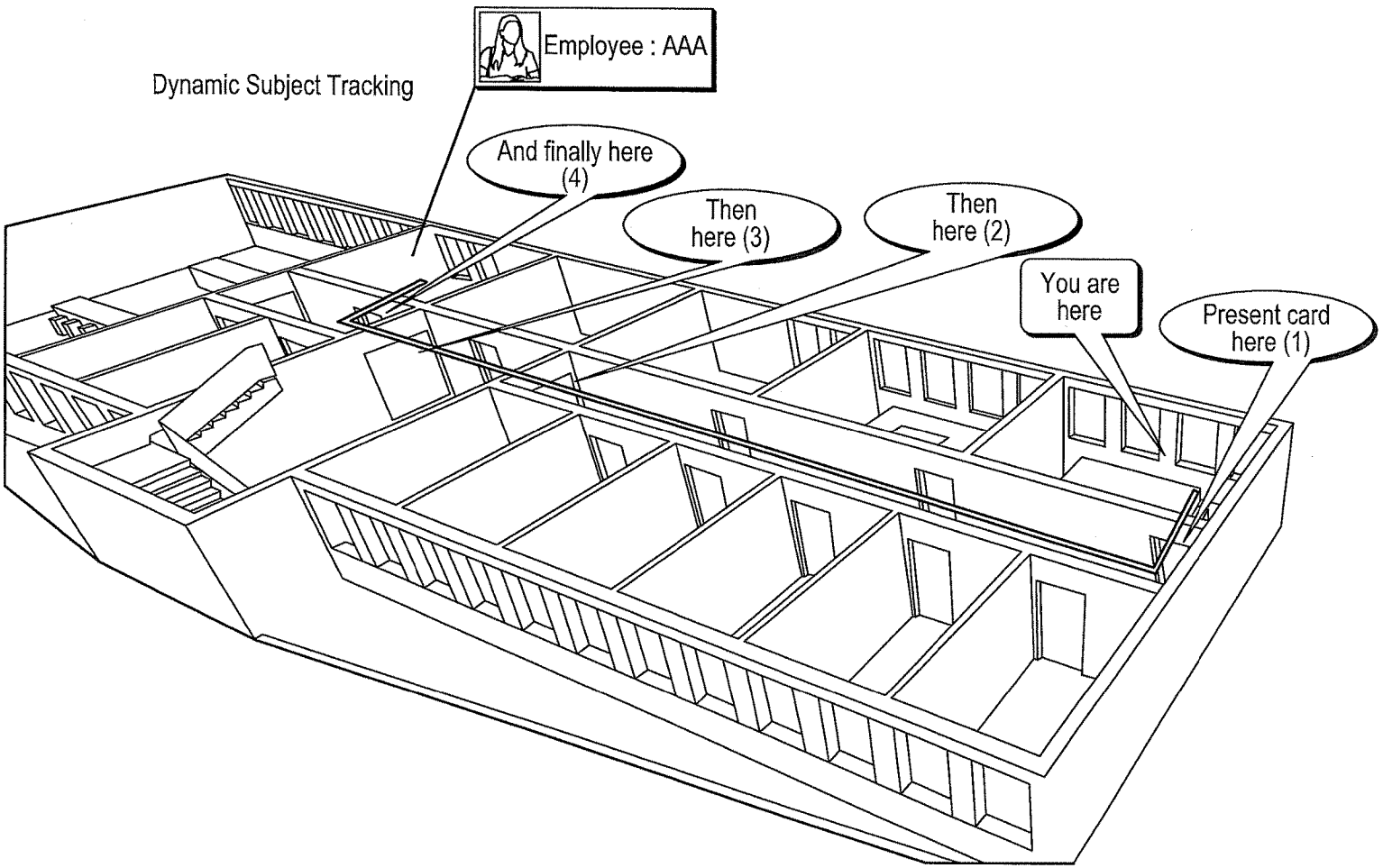
FIG. 3 depicts the display of a single tracked object that may be generated by the system of FIG. 1.

Alternatively, the guard may enter an identifier of a particular employee or asset. In response, the tracking processor may retrieve the location file(s) of the identified object. The tracking processor may then superimpose the location of the identified object as well as a sequence of locations as shown in FIG. 3. The same process can be used to track the locations of the various assets (e.g., vehicle, laptop(s), other hardware, etc.) assigned to the person based upon the detected locations of the tag or card attached to each of the assets.

In another illustrated embodiment, consider the scenario of a visitor arriving at the premises (i.e., the secured area) of a company for a meeting with an employee (authorized person within the secured area). Once the visitor has reached the premise, the visitor is issued a temporary card, and the employee is able to use his mobile phone to access the tracking processor of the system in order to locate the visitor. Similarly, visitors can track their hosts and reach out to them in a more convenient way. Based upon the location where the card was last read, the exact location of the user can be identified in the BIM model.

In still another model, the user/visitor arrives at the location of the company and notifies the guard of a particular area that the visitor would like to visit. The guard issues a card to the visitor where the card incorporates the geographic coordinates of the intended destination. In this case, the tracking processor creates a track that will be followed by the visitor in order for the visitor to reach his/her intended destination based upon the BIM model. The tracking processor may also be used to display an emergency path to the nearest exit in the event of an emergency.

In a more particular example, assume that the entire facility is provided with access control readers distributed throughout the area and is integrated with one or more tracking processors with access to the BIM model. Once the user enters the facility, he/she is given access to the BIM file through his/her mobile phone. The BIM file is restricted so as to display only the necessary information to the user. The data that is superfluous to the user is masked. Once the user presents his/her card to any reader, the tracking processor is alerted to the current location of the user and shall update the location files of the user in the BIM model. If a user has multiple objects associated with the user, and the user requests location information, then the location of all of the objects will be displayed to the user through the user interface upon demand. In this case, the tracking processor retrieves the location of each of the objects. The location of each of the objects is dynamically tracked and displayed on the mobile device. Based upon the user's privileges and needs, the location of and paths to each of the objects can be displayed. This idea can be extended to integrate with other security systems so as to stream live videos from the cameras in the zones of interest as each of the objects moves through the respective areas.

In the general, the system includes a user input of a security system receiving a respective identifier for each of a plurality of objects to be tracked within a secured area having a plurality of geographically separate spaces managed by multiple access controllers and a processor of the security system detecting entry of one of the plurality of objects into one of the plurality of geographically separate spaces via one of the access controllers associated with the one of the geographically separate spaces, determining a geographic location of the one of the plurality of objects based upon detecting the entry, retrieving a map of the secured area along with a track of the one of the plurality of objects through the secured area, and displaying the geographic location of the one of the plurality of objects on the map through one of a portable handheld device, a monitoring station, and other possible human machine interface devices.

Alternatively, the system includes a user input of a security system receiving an identifier of an object to be tracked within a secured area having a plurality of geographically separate spaces separated by access controllers and a processor of the security system detecting entry of the object to be tracked into one of the plurality of geographically separate spaces via one of the access controllers associated with the one of the plurality of geographically separate spaces, determining a geographic location of the object to be tracked based upon detecting the entry, retrieving a map of the secured area, correlating the geographic location with a corresponding location on the map, and displaying the object to be tracked on the map.

Alternatively, the system includes a user input of a security system that receives an identifier of an object to be tracked within a secured area having a plurality of geographically separate spaces separated by access controllers and a processor of the security system that detects entry of the object to be tracked into one of the plurality of geographically separate spaces via one of the access controllers associated with the one of the plurality of geographically spaces, that determines a geographic location of the object to be tracked based upon detecting the entry, that retrieves a map of the secured area, that correlates the geographic location with a corresponding location on the map, and that displays the object to be tracked on the map.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. A method comprising:

a user interface of a security system receiving a respective identifier, entered by a user, for each of a plurality of objects to be tracked within a secured area having a plurality of geographically separate spaces, wherein each of the plurality of geographically separate spaces is managed by a respective one of a plurality of access controllers, and wherein at least one of the plurality of objects is a security guard;

a processor of the security system detecting entry of the security guard into a first geographically separate space of the plurality of geographically separate spaces via a first access controller of the plurality of access controllers associated with the first geographically separate space of the plurality of geographically separate spaces;

the processor of the security system determining a geographic location of the security guard based upon the entry detected;

the processor of the security system retrieving a map of the secured area;

the processor of the security system displaying the geographic location of the security guard on the map through one of a portable handheld device, a monitoring station, and an interface device;

the processor of the security system detecting a security threat in the first geographically separate space of the plurality of geographically separate spaces;

the processor of the security system determining that the security guard is in the first geographically separate space of the plurality of geographically separate spaces; and the processor of the security system transmitting a notification of the security threat in the first geographically separate space of the plurality of geographically separate spaces to the portable handheld device associated with the security guard.

2. The method as in claim 1 further comprising dynamically tracking each of the plurality of objects and displaying the geographic location of each of the plurality of objects on the map.

3. The method as in claim 1 wherein the security threat is an unauthorized intruder.

4. A method comprising:

a user interface of a security system receiving an identifier, entered by a user, of an object to be tracked within a secured area having a plurality of geographically separate spaces, wherein entry into each of the plurality of geographically separate spaces is controlled by a respective access controller, and wherein the object to be tracked is a security guard;

a processor of the security system detecting entry of the object to be tracked into one of the plurality of geographically separate spaces via the respective access controller controlling the one of the plurality of geographically separate spaces;

the processor of the security system determining a geographic location of the object to be tracked based upon the entry detected;

the processor of the security system retrieving a map of the secured area;

the processor of the security system correlating the geographic location of the object to be tracked with a corresponding location on the map;

the processor of the security system displaying the object to be tracked on the map;

the processor of the security system detecting a security threat in the one of the plurality of geographically separate spaces;

the processor of the security system determining that the security guard is in the one of the plurality of geographically separate spaces based on the geographic location of the object to be tracked; and the processor of the security system transmitting a notification of the security threat in the one of the plurality of geographically separate spaces to a portable device associated with the security guard.

5. The method as in claim 4 further comprising the processor of the security system tracking an intruder, wherein the security threat is the intruder.

6. The method as in claim 5 further comprising a display depicting the geographic location of the security threat superimposed on the map.

7. The method as in claim 4 further comprising the user interface receiving an intended destination from the user.

8. The method as in claim 7 further comprising depicting the intended destination on the map along with a path to the intended destination.

9. The method as in claim 4 further comprising defining a second object as an asset.

10. The method as in claim 4 further comprising tracking the geographic location of the object to be tracked and displaying the geographic location on the map.

11. The method as in claim 4 further comprising a plurality of objects.

12. The method as in claim 11 wherein the step of the user interface receiving the identifier of the object to be tracked further comprises the user interface receiving a plurality of identifiers, and wherein each of the plurality of identifiers is associated with a respective one of the plurality of objects.

13. A system comprising:

a user interface of a security system that receives an identifier, entered by a user, of an object to be tracked within a secured area having a plurality of geographically separate spaces via access controllers, wherein each of the plurality of geographically separate spaces is managed by a respective one of the access controllers, and wherein the object is a security guard; and a processor of the security system that detects entry of the object to be tracked into one of the plurality of geographically separate spaces via the respective one of the access controllers managing the one of the plurality of geographically separate spaces, that determines a geographic location of the object to be tracked based upon the entry detected, that retrieves a map of the secured area, that correlates the geographic location of the object to be tracked with a corresponding location on the map, that displays the object to be tracked on the map, that detects a security threat in the one of the plurality of geographically separate spaces, that determines that the security guard is in the one of the plurality of geographically separate spaces based on the geographic location of the object to be tracked, and that transmits a notification of the security threat in the one of the plurality of geographically separate spaces to a portable device associated with the security guard.

14. The system as in claim 13 wherein the processor detects entry of a plurality of objects.

15. The system as in claim 14 wherein the processor tracks the plurality of objects.

16. The system as in claim 15 wherein the processor simultaneously depicts each of the plurality of objects on the map.

17. The system as in claim 16 wherein the security threat is an intruder.

18. The system as in claim 13 wherein the processor detects the geographic location of the security threat.

19. The system as in claim 18 wherein the processor depicts the geographic location of a plurality of objects proximate the security threat.

* * * * *